US012723817B2

(12) United States Patent
Lee et al.

(10) Patent No.: US 12,723,817 B2
(45) Date of Patent: Sep. 1, 2026

(54) MANIFOLD FLUID MODULE

(71) Applicant: Hanon Systems, Daejeon (KR)

(72) Inventors: Kyeong Cheol Lee, Daejeon (KR); In Keun Kang, Daejeon (KR); Young Man Kim, Daejeon (KR); In Hyeok Kim, Daejeon (KR); Jae Min Lee, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 138 days.

(21) Appl. No.: 18/832,644

(22) PCT Filed: Mar. 30, 2023

(86) PCT No.: PCT/KR2023/004260
§ 371 (c)(1),
(2) Date: Jul. 25, 2024

(87) PCT Pub. No.: WO2023/204473
PCT Pub. Date: Oct. 26, 2023

(65) Prior Publication Data

US 2025/0102230 A1 Mar. 27, 2025

(30) Foreign Application Priority Data

Apr. 18, 2022 (KR) ..... 10-2022-0047688

(51) Int. Cl.
*F28D 1/053* (2006.01)
*F28D 1/04* (2006.01)

(52) U.S. Cl.
CPC ..... *F28D 1/05366* (2013.01); *F28D 1/0426* (2013.01)

(58) Field of Classification Search
CPC ..... F28D 1/05366; F28D 1/0426; B60H 1/00321; B60H 1/00342; B60H 1/00528;
(Continued)

(56) References Cited

U.S. PATENT DOCUMENTS

2021/0086587 A1 3/2021 Koberstein et al.
2023/0415541 A1* 12/2023 Lin ..... B60H 1/00392

FOREIGN PATENT DOCUMENTS

CN 113276630 A 8/2021
KR 102189058 B1 12/2020
(Continued)

OTHER PUBLICATIONS

KR_20200139094_A translation.*
International Search Report issued in PCT/KR2023/004260 on Jun. 29, 2023.

*Primary Examiner* — Elizabeth J Martin
(74) *Attorney, Agent, or Firm* — NORTON ROSE FULBRIGHT US LLP

(57) ABSTRACT

The present invention relates to a manifold fluid module. A manifold fluid module according to an embodiment of the present invention may include a manifold plate comprising a fluid passage formed internally, and a heat exchanger coupled to the manifold plate, configured to exchange heat between a first fluid and a second fluid, and comprising a first inlet port for inlet of the first fluid, a first outlet port for outlet of the first fluid, a second inlet port for inlet of the second fluid, and a second outlet port for outlet of the second fluid, wherein the first inlet port and the first outlet port of the heat exchanger may connected to communicate with the fluid passage, one of the first inlet port or the outlet port being directly connected to the manifold plate, the other being connected to a fluid pipe.

15 Claims, 6 Drawing Sheets

(58) Field of Classification Search
CPC .. B60H 1/05366; B60H 1/143; B60H 1/3229;
B60H 1/485; B60Y 220/91
See application file for complete search history.

(56) References Cited

FOREIGN PATENT DOCUMENTS

| | | | | | |
|---|---|---|---|---|---|
| KR | 20200139094 | A | * | 12/2020 | ..... B60H 1/000342 |
| KR | 20210022220 | A | | 3/2021 | |
| KR | 102359325 | B1 | | 2/2022 | |

* cited by examiner

MANIFOLD FLUID MODULE

CROSS REFERENCE TO RELATED APPLICATIONS

This patent application is a national phase under 35 U.S.C. § 371 of International Patent Application No. PCT/KR2023/004260 filed Mar. 30, 2023, which claims the benefit of priority from Korean Patent Application No. 10-2022-0047688 filed Apr. 18, 2022, each of which is hereby incorporated herein by reference in its entirety for all purposes.

TECHNICAL FIELD

The present invention relates to a manifold fluid module, and more particularly, to a manifold fluid module that integrates components such as heat exchangers and valves into a single unit.

BACKGROUND ART

Amidst the growing emphasis on environmentally friendly industrial development and the pursuit of energy sources to replace fossil fuels, electric vehicles and hybrid vehicles have emerged as the most prominent areas of interest in the automotive industry. Both electric vehicles and hybrid vehicles are equipped with batteries to provide driving power, and these batteries are also utilized for heating and cooling purposes in addition to driving operations.

In vehicles that rely on batteries for propulsion, using the battery as a heat source for heating and cooling inevitably leads to a reduction in driving range; to address this issue, the integration of heat pump systems, which have been widely employed in residential heating and cooling systems, into automobiles has been proposed.

Essentially, a heat pump operates by absorbing low-temperature heat and transferring it to a higher temperature. For example, a heat pump cycle involves a liquid fluid evaporating in an evaporator, absorbing heat from its surroundings and becoming a gas, then releasing heat to its surroundings through a condenser and becoming liquid again. Applying this principle to electric or hybrid vehicles offers the advantage of providing a supplementary heat source that is absent in conventional air conditioning systems.

Current electric vehicle heat pump systems employ a partial modularization approach where key components (valves, accumulators, chillers, condensers, internal heat exchangers, sensors, etc.) are connected by piping, requiring separate fittings and connectors for these connections and resulting in necessary spacing between components. These factors lead to drawbacks in terms of packaging, cost, and workability.

To resolve this, technology for modularizing the manifold is being developed, but during the modularization process, there was an issue of performance degradation due to thermal interference between high-temperature and low-temperature fluids.

DISCLOSURE

Technical Problem

The present invention aims to provide a manifold fluid module having a structure capable of minimizing thermal interference between high-temperature and low-temperature fluids.

Technical Solution

A manifold fluid module according to an embodiment of the present invention may include a manifold plate comprising a fluid passage formed internally, and a heat exchanger coupled to the manifold plate, configured to exchange heat between a first fluid and a second fluid, and comprising a first inlet port for inlet of the first fluid, a first outlet port for outlet of the first fluid, a second inlet port for inlet of the second fluid, and a second outlet port for outlet of the second fluid, wherein the first inlet port and the first outlet port of the heat exchanger may connected to communicate with the fluid passage, one of the first inlet port or the outlet port being directly connected to the manifold plate, the other being connected to a fluid pipe.

The fluid pipe may be connected, at one end thereof, to the first inlet port or the first outlet port and, at the other end thereof, to the manifold plate to communicate with the fluid passage.

The first fluid flowing through the fluid pipe may differ in temperature from the first fluid flowing through the fluid passage.

The fluid passage is formed in plurality within the manifold plate, each differing in temperature.

Among the plurality of fluid passages, the temperature of the fluid passage closer to the fluid pipe may be the lowest.

Among the plurality of fluid passages, the temperature of the fluid passage closer to the fluid pipe may be the highest.

The heat changer may be a water-cooled condenser or a chiller.

The heat exchanger may be provided in plurality, the plurality of heat exchangers comprising a water-cooled condenser and a chiller.

The water-cooled condenser may be vertically arranged on the manifold plate, and the chiller may be horizontally positioned on the manifold plate.

The water-cooled condenser may be arranged on one side of the manifold plate, and the chiller may be laterally arranged to the water-cooled condenser.

The manifold fluid module may further include a first expansion valve configured to expand the first fluid entering the water-cooled condenser, and a second expansion valve configured to expand the first fluid entering the chiller, wherein the first expansion valve and the second expansion valve may be arranged above the water-cooled condenser and the chiller, respectively, allowing the first fluid introduced into the water-cooled condenser and the chiller to move from top to bottom.

The manifold fluid module may further include a first direction switching valve and a second direction switching valve configured to control the direction of the first fluid discharged from the water-cooled condenser, wherein the first direction switching valve and the second direction switching valve may be arranged above the water-cooled condenser.

The first expansion valve, the first direction switching valve, and the second direction switching valve may be arranged on the upper part of the manifold plate, the water-cooled condenser may be arranged on one side of the lower part of the manifold plate, and the chiller and the second expansion valve may be arranged on the other side of the lower part of the manifold plate.

A manifold fluid module according to another embodiment of the present invention may include a manifold plate including a fluid passage formed internally, a heat exchanger coupled to the manifold plate, configured to exchange heat between a first fluid and a second fluid, and including a first inlet port for inlet of the first fluid, a first outlet port for outlet of the first fluid, a second inlet port for inlet of the second fluid, and a second outlet port for outlet of the second fluid, and a thermal interference prevention unit configured to prevent the first fluid entering or exiting through the first inlet port or the first outlet port of the heat exchanger from experiencing thermal interference with the fluid passage.

The thermal interference prevention unit may include an air insulation layer defining a predetermined spacing from the fluid passage.

Advantageous Effect

A manifold fluid module according to an embodiment of the present invention is advantageous in terms of improving the performance of the heat pump by minimizing thermal interference between high-temperature and low-temperature fluids in such a way as to form the flow path of the high-temperature fluid through a thermal interference prevention part, such as a separate pipe.

MODE FOR INVENTION

Figure 1:
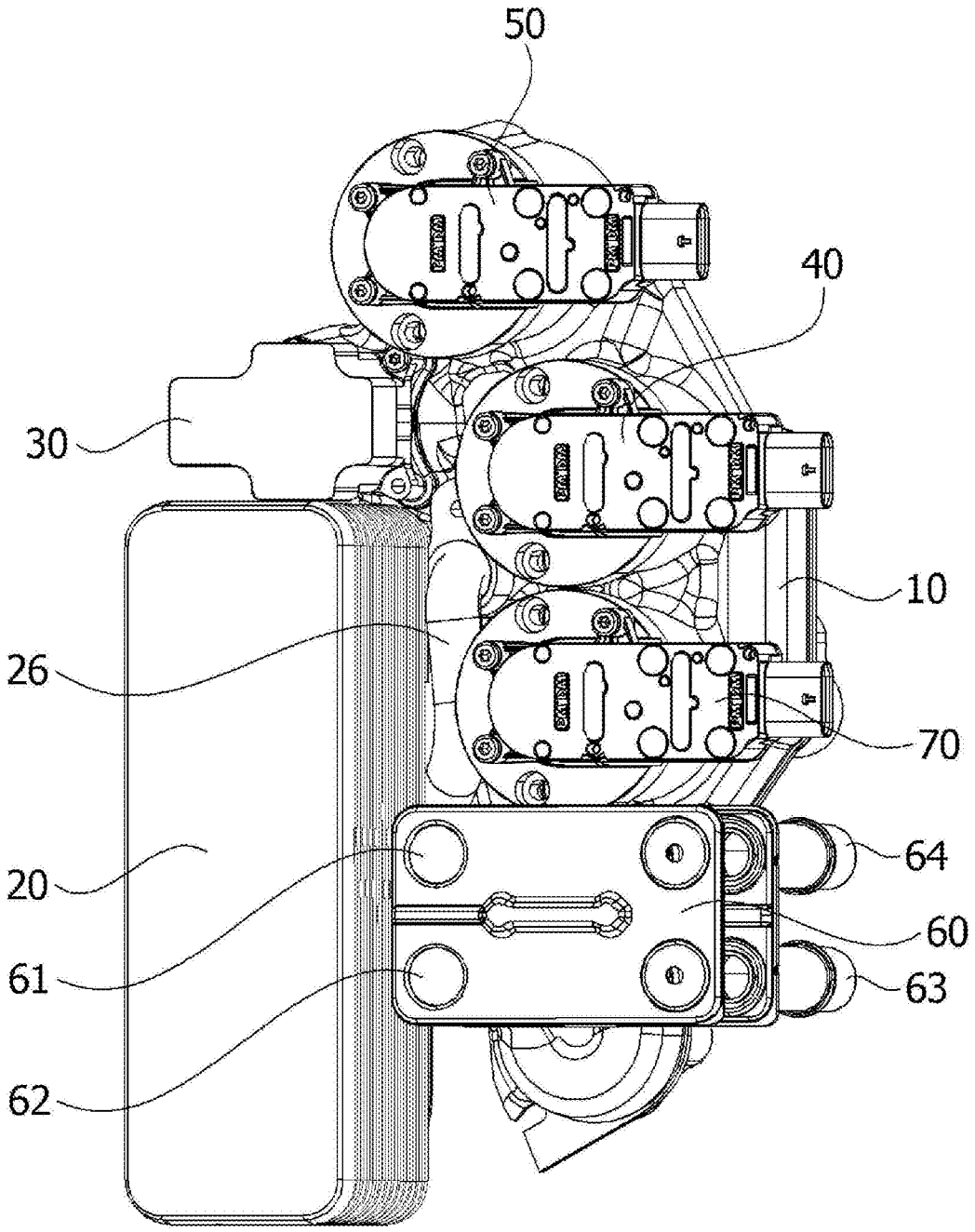
FIG. 1 is a perspective view illustrating the front side of a manifold fluid module according to an embodiment of the present invention.

While the present invention admits various modifications, the following detailed descriptions and drawings focus on preferred embodiments for clarity. However, such embodiments are not intended to limit the invention and it should be understood that the embodiments encompass all modifications, equivalents, and alternatives within the spirit and scope of the invention. Detailed descriptions of well-known technologies may be omitted to avoid obscuring the subject matter of the present invention.

Terms such as "first," "second," etc. may be used to describe various components, but the components should not be limited by these terms. The terms are used only for distinguishing one component from another component.

The terminology used in this application is employed merely to describe specific embodiments and is not intended to limit the scope of the present invention. The singular forms are intended to include the plural forms as well unless the context clearly indicates otherwise. In this application, terms such as "comprising" or "having" indicate the presence of the features, numbers, steps, operations, components, or parts listed in the specification, without excluding the presence or possibility of one or more other features, numbers, steps, operations, components, or parts or their combinations.

Throughout the specification, the term "connected" not only means that two or more components are directly connected but also includes indirect connections via intermediary components, electrical connections, and instances where components are referred to by different names based on their position or function but are considered as a whole.

Hereinafter, a description is made of the manifold fluid module according to an embodiment of the present invention with reference to accompanying drawing, where identical or corresponding components are assigned the same reference numerals and repetitive descriptions are omitted.

Figure 2:
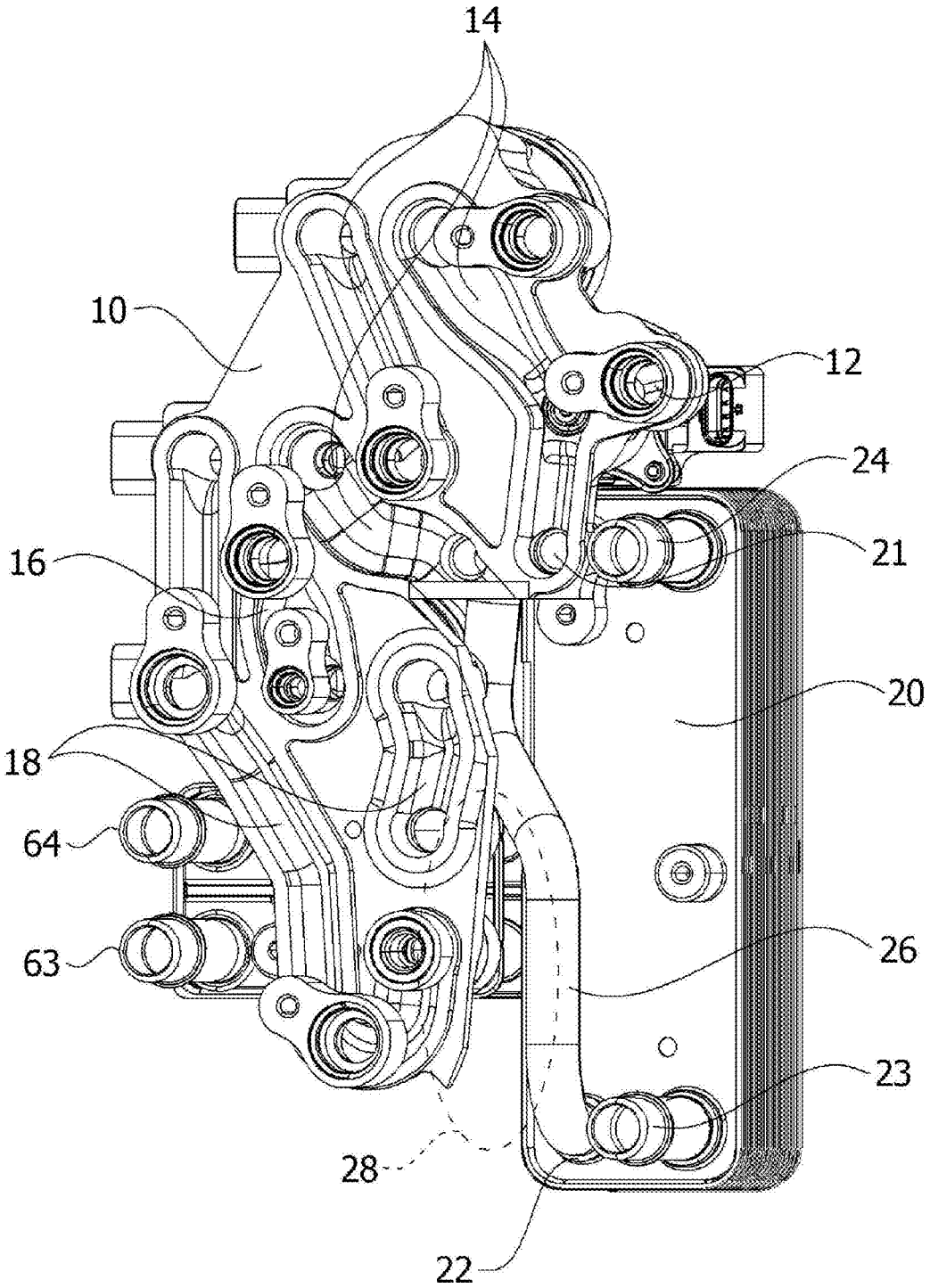
FIG. 2 is a perspective view illustrating the rear of a manifold fluid module according to an embodiment of the present invention.

FIG. 1 is a perspective view illustrating the front side of a manifold fluid module according to an embodiment of the present invention, and FIG. 2 is a perspective view illustrating the rear of a manifold fluid module according to an embodiment of the present invention.

As shown in the drawings, the manifold fluid module according to an embodiment of the present invention may include a manifold plate 10 forming fluid passages 14, 16, and 18 therein, and a heat exchanger for heat exchange between a first fluid and a second fluid, the heat exchanger including a first inlet port 21 for introducing the first fluid, a first outlet port 22 for discharging the first fluid, a second inlet port 23 for introducing the second fluid, and a second outlet 24 for discharging the second fluid. The first inlet port 21 and the first outlet port 22 of the heat exchanger are connected to communicate with the fluid passages 14, 16, and 18, either the first inlet port 21 or the first outlet port 22 being directly connected to the manifold plate 10 and the other connected to a fluid pipe 26.

The heat exchanger may be any device that allows heat exchange between the first fluid, a refrigerant, and the second fluid, a coolant; for convenience, a water-cooled condenser 20 and a chiller 60 are illustrated as examples below. The manifold plate 10 include a plurality of fluid passages 14, 16, and 18 formed inside, exhibiting a various temperature distribution, ranging from high to low, due to heat exchange of the fluid flowing therethrough. The manifold plate 10 may accommodate the integration of a plurality of components constituting a heat pump system. In this embodiment, the manifold plate 10 may accommodate the integration of a water-cooled condenser 20, a first expansion valve 30, a first direction switching valve 40, a second direction switching valve 50, a chiller 60, and a second expansion valve 70 for heat exchange purposes.

The manifold plate 10 is generally formed with fluid passages inside and has a plate shape with a predetermined thickness. The manifold plate 10 may be modularized by combining the water-cooled condenser 20, the chiller 60, the expansion valves 30 and 60, and the direction switching valves 40 and 50 for a heat pump system, thereby reducing the number of manufacturing steps and assembly line steps for vehicles. In addition, the manifold plate 10 may reduce costs and improve workability by performing the functions of piping, fittings, and housing at the same time.

With reference to FIG. 2, a fluid inlet port 12 is provided on the back of the manifold plate 10 into which high-temperature, high-pressure gaseous fluid discharged from a compressor or internal condenser is introduced. On the rear side of the manifold plate 10, the plurality of fluid passages 14, 16, and 18 are formed to guide the movement of the fluid. The fluid passages 14, 16, and 18 are formed recessed into the rear side of the manifold plate 10 to facilitate heat exchange, expansion, inflow, and outflow of the fluid.

In this embodiment, the fluid passages 14, 16, and 18 are configured to three distinct fluid passages based on temperature distribution of the fluid. Firstly, the first fluid passage (14) serves as the path through which high-temperature fluid flows, encompassing the route from the inlet of the initially introduced high-temperature, high-pressure first fluid into the manifold plate 10 to its discharge from the water-cooled condenser 20. The second fluid passage 16 serves as the path through which the low-temperature, low-pressure first fluid flows, encompassing the route to its discharge into the evaporator (not shown). The third fluid passage 18 serves as the path through which the low-temperature, low-pressure first fluid flows, encompassing the route where the first fluid from the evaporator undergoes heat exchange in the chiller (60) and is then discharged.

The first to third fluid passages, 14, 16, and 18, are categorized based on the temperature distribution of the fluid, with approximately 65° C. for the first fluid passage 14, 5° C. for the second fluid passage 16, and 20° C. for the third fluid passage 18.

A water-cooled condenser 20 serves to exchange heat between the high-temperature, high-pressure gaseous fluid discharged from a compressor or internal condenser with an external heat source, thereby condensing the fluid into a high-pressure liquid. The high-temperature, high-pressure gaseous fluid is introduced into the water-cooled condenser 20 through the fluid inlet port 12. Thus, the water-cooled condenser 20 may be regarded as the first heat exchanger performing heat exchange in the fluid module.

The water-cooled condenser 20 is provided with the first inlet port 21 and the first outlet port 22 located at the top and bottom of its rear side, respectively. The first inlet port 21 serves as the entry point of the first fluid passed through the first fluid passage 14, while the first outlet port 22 serves as the exit point of the first fluid after heat exchange in the water-cooled condenser 20. The first inlet port 21 and the first outlet port 22 may be formed at the top and bottom of the water-cooled condenser 20, respectively, in the form of a hole.

The water-cooled condenser 20 is also provided with the second inlet port 23 and the second outlet port 24 located at the bottom and top of its rear side, respectively. The second inlet port 23 serves as the entry point of the second fluid, while the second outlet port 24 serves as the exit point of the second fluid after heat exchange with the first fluid. The second fluid flows in the opposite direction (bottom to top) compared to the first fluid, while undergoing heat exchange with the first fluid.

Meanwhile, as described above, since the first fluid passage 14 is relatively high in temperature compared to the second and third fluid passages 16 and 18, thermal interference occurs between the fluid passages during the flow of the fluid. In this case, the most effective approach is to design the first fluid passage 14 with a sufficient gap from the second and third fluid passages 16 and 18; however, due to the nature of modular products, there are limitations in securing enough space.

Therefore, in this embodiment, a separate fluid pipe 26 may be connected to the first outlet port 22 of the water-cooled condenser 20, as shown in FIG. 2. One end of the fluid pipe 26 is connected to the first outlet port 22, and the other end is directly connected to the manifold plate 10, thereby effectively communicating with the first fluid passage 14.

Connecting the fluid pipe 26 to the manifold plate 10 as described allows the high-temperature first fluid passage to be maximally separated from the manifold plate 10, thereby minimizing thermal interference of the high-temperature first fluid to the second and third fluid passages 16 and 18 where the low-temperature first fluid flows.

For example, when the high-temperature first fluid enters the second fluid passage 16 of the manifold plate 10 without passing through a separate fluid pipe 26, direct thermal interference occurs with the low-temperature first fluid flowing within the manifold plate 10 (due to the plate's own heat conduction); however, by isolating the high-temperature fluid through the fluid pipe 26, thermal interference occurs indirectly, thereby minimizing the impact of the high-temperature fluid. By routing the first fluid through the fluid pipe 26 separately in this way, the temperature of the first fluid flowing through the fluid pipe 26 may differ from that of the first fluid flowing through the fluid passages 14, 16, and 18. Particularly, the temperature of the fluid passages 14, 16, and 18 closer to the fluid pipe 26 among the plurality of fluid passages 14, 16, and 18 may be the lowest or the highest.

Although shown as connected only to the first outlet port 22 in FIG. 2, the fluid pipe 26 may also be configured to connect to the first inlet port 21. This is designed because, in the arrangement of the water-cooled condenser 20, the segment where the first fluid is discharged and connected to the manifold plate 10 is longer than the segment where the first fluid is introduced; when the segment where the first fluid is introduced is longer than the segment where the first fluid is discharged, it may also be possible to configure the fluid pipe 26 to connect to the first inlet port 21.

The key point is to connect the fluid pipe 26 to either the first inlet port 21 or the first outlet port 22, thereby distancing the segment through which the high-temperature first fluid moves from the manifold plate 10, minimizing thermal interference between high-temperature and low-temperature fluids. This structure is capable of enhancing the heat exchange performance in the heat pump system.

As described above, in this embodiment, the fluid pipe 26 is used as an example of a thermal interference prevention unit to prevent the first fluid entering or exiting through the first inlet port 21 or the first outlet port 22 of the water-cooled condenser 20 from experiencing thermal interference with the fluid passages 14, 16, and 18. However, the thermal interference prevention unit, aside from the fluid pipe 26, may employ any configuration capable of isolating the flow of the first fluid.

The thermal interference prevention unit may also include an air insulation layer 28, which defines a predetermined spacing from the fluid passages 14, 16, and 18. Due to the presence of an air gap between the manifold plate 10 and the fluid pipe 26, thermal interference of the first fluid may be prevented by the air.

Meanwhile, the fluid pipe 26 is connected at one end to the condenser discharge port 24 located at the bottom of the water-cooled condenser 20, and the other end may be extended upwards and connected to the manifold plate 10. The other end of the fluid pipe 26 may be extended to the top of the water-cooled condenser 20, and guiding a long section from the fluid module to the top of the condenser via a separate component such as the fluid pipe 26 is capable of effectively minimizing thermal interference.

The first expansion valve 30 may be positioned at the top of the water-cooled condenser 20 and may control the expansion or passage of the first fluid entering through the fluid inlet port 12. The fluid entering through the first expansion valve 30 may pass through the water-cooled condenser 20, undergoing heat exchange, or proceed to move to an external heat exchanger.

After passing through the water-cooled condenser 20, the first fluid enters the fluid pipe 26 and is then directed to the first direction switching valve 40. The first fluid introduced into the first direction switching valve 40 may flow to the evaporator or an external heat exchanger. In dehumidification mode, the first fluid introduced into the first expansion valve 30 may be directed to the second direction switching valve 50 and then either to the evaporator or the first direction switching valve 40.

The chiller 60 is supplied with a low-temperature, low-pressure fluid for heat exchange with the coolant circulating in the coolant circulation line (not shown). The chilled coolant, which has undergone heat exchange in the chiller 60, may circulate through the coolant circulation line for heat exchange with the battery. The first fluid, after undergoing heat exchange with the external heat exchanger, flows into the second expansion valve 70 and, after being expanded in the second expansion valve 70, flows into the chiller 60. The first fluid, after undergoing heat exchange in the chiller 60, is discharged through the bottom and flows into the accumulator (not shown). Thus, the chiller 60 may be regarded as the second heat exchanger performing heat exchange in the fluid module.

The chiller 60 is provided with the first inlet port 61 and the first outlet port 62 located at the top and bottom of its rear side, respectively. The first inlet port 61 serves as the entry point of the first fluid, while the first outlet port 62 serves as the exit point of the first fluid after heat exchange in the chiller 60. The first inlet port 61 and the first outlet port 62 may be formed at the top and bottom of the chiller 60 in the form of a hole.

The chiller 60 is also provided with the second inlet port 63 and the second outlet port 64 located at the bottom and top of its rear side, respectively. The second inlet port 63 serves as the entry point of the second fluid, while the second outlet port 64 serves as the exit point of the second fluid after heat exchange with the first fluid. The second fluid flows in the opposite direction (bottom to top) compared to the first fluid, while undergoing heat exchange with the first fluid.

With reference back to FIG. 1, in this embodiment, the first expansion valve 30, the first direction switching valve 40, and the second direction switching valve 50 may be arranged on the upper part of the manifold plate 10, the water-cooled condenser 20 may be arranged on one side of the lower part of the manifold plate 10, and the chiller 60 and the second expansion valve 70 may be arranged on the other side of the lower part of the manifold plate 10.

That is, arranging the aforementioned components on the manifold plate 10 allows for optimal placement of the components in minimal space, thereby maximizing spatial efficiency, and the overall top-to-bottom formation of the fluid flow optimizes the fluid flow as well.

In particular, the water-cooled condenser 20 is arranged vertically on one side of the lower part of the manifold plate 10, and the chiller 60 is arranged horizontally on the other side of the lower part of the manifold plate 10, thereby optimizing the fluid module package. That is, the chiller 60 is arranged laterally to the water-cooled condenser 20, thereby enhancing space efficiency.

The first expansion valve 30 is arranged above the water-cooled condenser 20, and the second expansion valve 70 is arranged above the chiller 60, allowing the first fluid introduced into the water-cooled condenser 20 and the chiller 60 to flow from top to bottom.

In this way, the valves are clustered on the upper and central parts of the manifold plate 10, considering the thickness of the valves themselves, and such clustering facilitates manufacturing in processes such as forging.

Although the above description primarily uses the water-cooled condenser 20 as an example of the first heat exchanger, this is not an exclusive configuration, and it is also possible to connect the fluid pipe 26 to the first inlet port 61 or first outlet port 62 of the chiller 60, which is the second heat exchanger.

Figure 3:
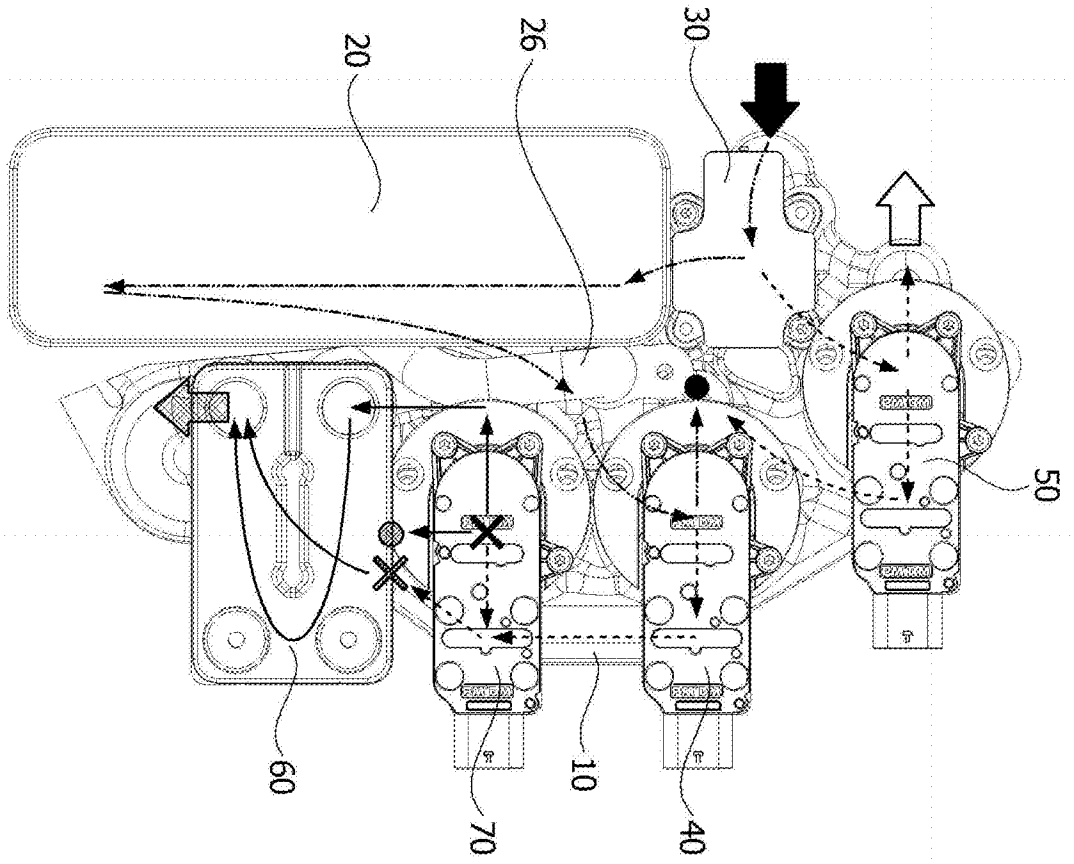
FIG. 3 is a diagram illustrating the flow of fluid in air conditioning mode according to an embodiment of the present invention.
Figure 4:
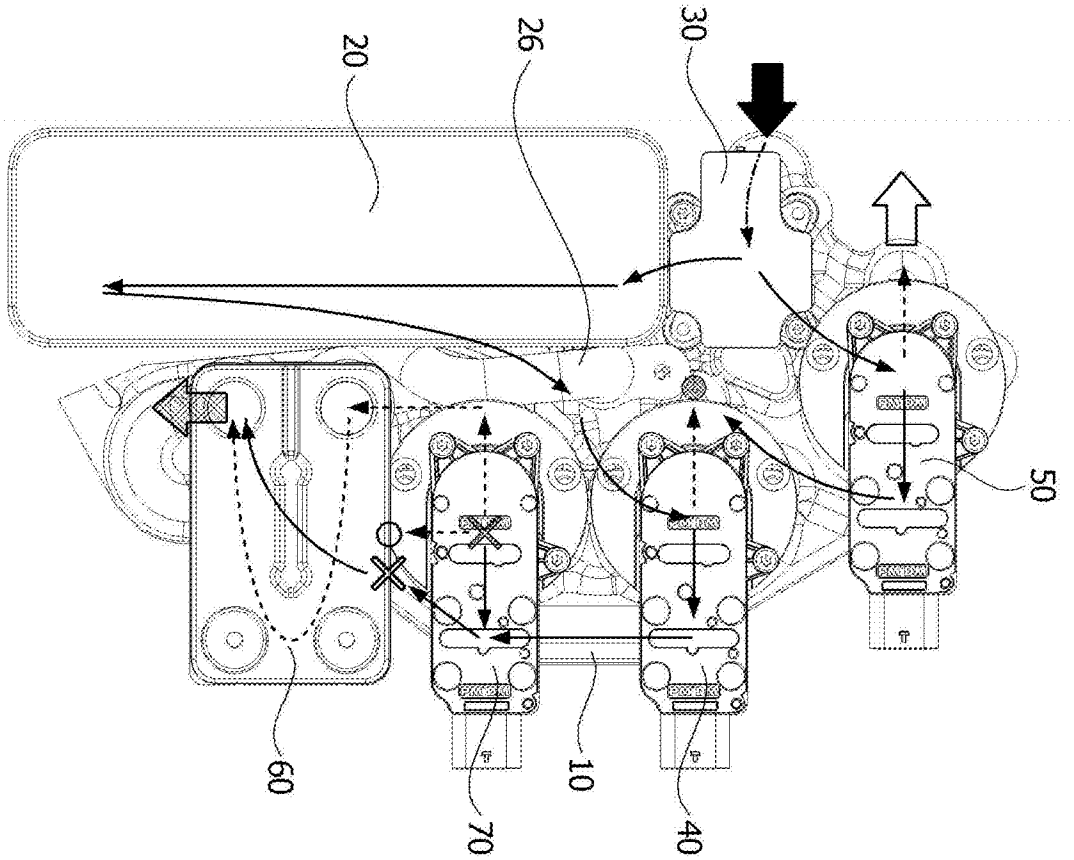
FIG. 4 is a diagram illustrating the flow of fluid in heat pump mode according to an embodiment of the present invention.

FIG. 3 is a diagram illustrating the flow of fluid in air conditioning mode according to an embodiment of the present invention, and FIG. 4 is a diagram illustrating the flow of fluid in heat pump mode according to an embodiment of the present invention.

With reference to FIG. 3, in air conditioning mode, the first fluid entering through the fluid inlet port 12 from the compressor or internal condenser passes through the open first expansion valve 30, enters the top of the water-cooled condenser 20, and then moves to the bottom. The first fluid discharged through the first outlet port 22 of the water-cooled condenser 20 flows into the first direction switching valve 40 via the fluid pipe 26.

The first fluid introduced into the first switching valve 40 is directed to the external heat exchanger, and during this process, the second switching valve 50 remains closed, preventing the first fluid from entering.

Meanwhile, the first fluid entering the second expansion valve 70 is introduced into the chiller 60 and exchanges heat with the coolant circulating in the coolant circulation line. The chilled coolant, which has undergone heat exchange in the chiller 60, may circulate through the coolant circulation line for heat exchange with the battery. The first fluid discharged from the bottom of the chiller 60 is introduced into the accumulator (not shown), where the first fluid is separated into gas and liquid phases; the gaseous phase is introduced into the compressor and then the first fluid circulates through the heat pump system.

In dehumidification mode, the first fluid flows from the first expansion valve 30 to the second direction switching valve 50 and may be discharged to the evaporator.

With reference to FIG. 4, in heat pump mode, the first fluid entering through the fluid inlet port 12 expands through the first expansion valve 30 and may flow into the water-cooled condenser 20 and the second direction switching valve 50.

The first fluid entering the second direction switching valve 50 may be introduced to the external heat exchanger, and the first fluid passed through the water-cooled condenser 20 may be introduced to the first direction switching valve 40. The first fluid entering from the external heat exchanger to the second expansion valve 70 is introduced into the chiller 60 and then moves to the accumulator.

Figure 5:
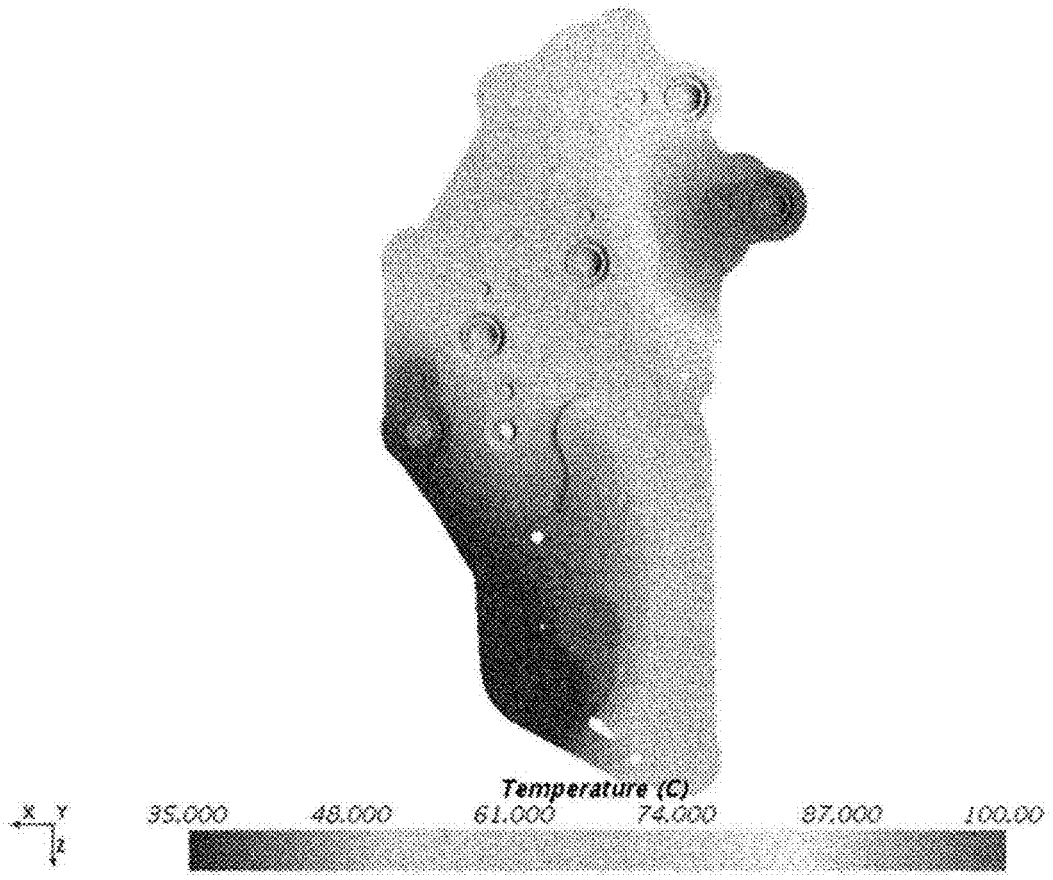
FIG. 5 is a diagram illustrating the temperature distribution of a manifold fluid module without a fluid pipe.
Figure 6:
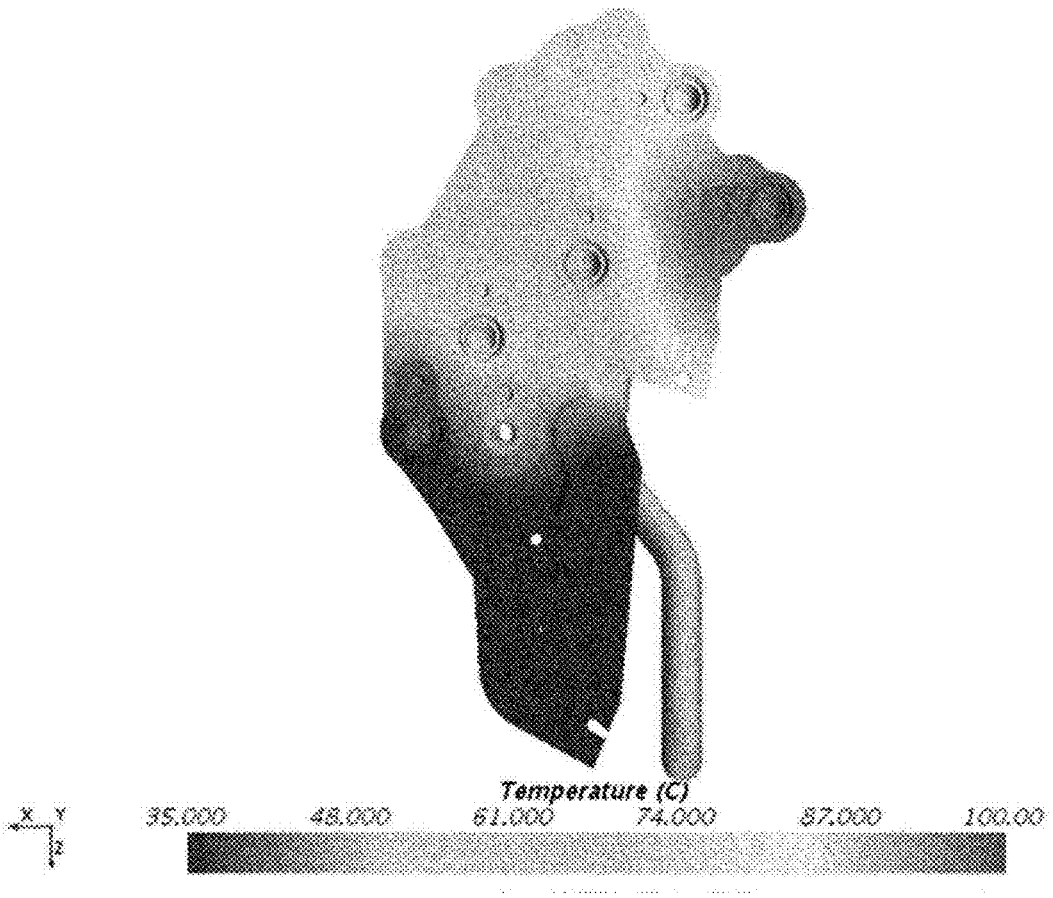
FIG. 6 is a diagram illustrating the temperature distribution of a manifold fluid module with a fluid pipe according to an embodiment of the present invention.

FIG. 5 is a diagram illustrating the temperature distribution of a manifold fluid module without a fluid pipe, and FIG. 6 is a diagram illustrating the temperature distribution of a manifold fluid module with a fluid pipe according to an embodiment of the present invention.

With reference to FIG. 5, it can be observed that in the absence of the fluid pipe 26, the sky blue region indicating relatively higher temperatures is more widely distributed in the area where the second and third fluid passages 16 and 18 are located, compared to the blue region. This implies that the low-temperature fluid passages 16 and 18 are directly influenced by the high-temperature fluid passage 14.

With reference to FIG. 6, it can be observed that in the presence of the fluid pipe 26, the blue region is more widely distributed in the area where the second and third fluid passages 16 and 18 are located. This implies that the low-temperature fluid passages 16 and 18 are indirectly influenced by the high-temperature fluid passage 14, resulting in a decrease in temperature variation. The actual temperature simulation results confirmed that the inlet and outlet temperature difference for the first to third fluid passages 14, 16, and 18 was reduced to between 0.5 and 4° C.

While the foregoing description has focused on specific embodiments of the present invention, it should be understood that various modifications and changes can be made by those skilled in the art without departing from the spirit and scope of the invention as defined in the appended claims.

DESCRIPTION OF REFERENCE NUMERALS

10: manifold plate
12: fluid inlet port
14: first fluid passage
16: second fluid passage
18: third fluid passage
20: water-cooled condenser
21: first inlet port
22: first outlet port
23: second inlet port
24: second outlet port
26: fluid pipe
28: air insulation layer
30: first expansion valve
40: first direction switching valve
50: second direction switching valve
60: chiller
61: first inlet port
62: first outlet port
63: second inlet port
64: second outlet port
70: second expansion valve

The invention claimed is:

1. A manifold fluid module comprising:

a manifold plate comprising a fluid passage formed internally; and a heat exchanger coupled to the manifold plate, configured to exchange heat between a first fluid and a second fluid, and comprising a first inlet port for inlet of the first fluid, a first outlet port for outlet of the first fluid, a second inlet port for inlet of the second fluid, and a second outlet port for outlet of the second fluid, wherein the first inlet port and the first outlet port of the heat exchanger are connected to communicate with the fluid passage, one of the first inlet port or the outlet port being directly connected to the manifold plate, the other being connected to a fluid pipe.

2. The manifold fluid module of claim 1, wherein the fluid pipe is connected, at one end thereof, to the first inlet port or the first outlet port and, at the other end thereof, to the manifold plate to communicate with the fluid passage.

3. The manifold fluid module of claim 1, wherein the first fluid flowing through the fluid pipe differs in temperature from the first fluid flowing through the fluid passage.

4. The manifold fluid module of claim 1, wherein the fluid passage comprises a plurality of fluid passages within the manifold plate, each differing in temperature.

5. The manifold fluid module of claim 4, wherein among the plurality of fluid passages, the temperature of the fluid passage closer to the fluid pipe is the lowest.

6. The manifold fluid module of claim 4, wherein among the plurality of fluid passages, the temperature of the fluid passage closer to the fluid pipe is the highest.

7. The manifold fluid module of claim 1, wherein the heat exchanger is a water-cooled condenser or a chiller.

8. The manifold fluid module of claim 1, wherein the heat exchanger comprises a plurality of heat exchangers, the plurality of heat exchangers comprising a water-cooled condenser and a chiller.

9. The manifold fluid module of claim 8, wherein the water-cooled condenser is vertically arranged on the manifold plate, and the chiller is horizontally positioned on the manifold plate.

10. The manifold fluid module of claim 8, wherein the water-cooled condenser is arranged on one side of the manifold plate, and the chiller is laterally arranged to the water-cooled condenser.

11. The manifold fluid module of claim 8, further comprising:

a first expansion valve configured to expand the first fluid entering the water-cooled condenser; and a second expansion valve configured to expand the first fluid entering the chiller, wherein the first expansion valve and the second expansion valve are arranged above the water-cooled condenser and the chiller, respectively, allowing the first fluid introduced into the water-cooled condenser and the chiller to move from top to bottom.

12. The manifold fluid module of claim 11, further comprising a first direction switching valve and a second direction switching valve configured to control the direction of the first fluid discharged from the water-cooled condenser, wherein the first direction switching valve and the second direction switching valve are arranged above the water-cooled condenser.

13. The manifold fluid module of claim 12, wherein the first expansion valve, the first direction switching valve, and the second direction switching valve are arranged on the upper part of the manifold plate, the water-cooled condenser is arranged on one side of the lower part of the manifold plate, and the chiller and the second expansion valve is arranged on the other side of the lower part of the manifold plate.

14. A manifold fluid module comprising:

a manifold plate comprising a fluid passage formed internally;

a heat exchanger coupled to the manifold plate, configured to exchange heat between a first fluid and a second fluid, and comprising a first inlet port for inlet of the first fluid, a first outlet port for outlet of the first fluid, a second inlet port for inlet of the second fluid, and a second outlet port for outlet of the second fluid; and a thermal interference prevention unit configured to prevent the first fluid entering or exiting through the first inlet port or the first outlet port of the heat exchanger from experiencing thermal interference with the fluid passage.

15. The manifold fluid module of claim 14, wherein the thermal interference prevention unit comprises an air insulation layer defining a predetermined spacing from the fluid passage.

* * * * *